US005788126A

United States Patent [19]

Chang

[11] Patent Number: 5,788,126

[45] Date of Patent: Aug. 4, 1998

[54] DRIPLESS DRIVE RESISTANCE CLIP FOR CAULK DISPENSING DEVICES

[76] Inventor: Peter J. Y. Chang, 11001 Petersborough Dr., Rockville, Md. 20852

[21] Appl. No.: 586,187

[22] Filed: Jan. 16, 1996

Related U.S. Application Data

[63] Continuation-in-part of Ser. No. 491,119, Jun. 16, 1995, Pat. No. 5,529,225, and Ser. No. 495,800, Jun. 27, 1995, Pat. No. 5,653,363, which is a continuation-in-part of Ser. No. 296,647, Aug. 26, 1994, abandoned, which is a continuation-in-part of Ser. No. 205,655, Mar. 2, 1994, Pat. No. 5,381,931, said Ser. No. 491,119, Jun. 16, 1995, Pat. No. 5,529,225, is a division of Ser. No. 296,647, Aug. 26, 1994, abandoned, which is a continuation-in-part of Ser. No. 205,655, Mar. 2, 1994, Pat. No. 5,381,931.

[51] Int. Cl.[6] ..... B67D 5/42

[52] U.S. Cl. ..... 222/391; 222/327

[58] Field of Search ..... 222/391, 325, 222/326, 327, 340

[56] References Cited

U.S. PATENT DOCUMENTS

| | | | |
|---|---|---|---|
| 4,009,804 | 3/1977 | Costa et al. | 222/391 |
| 5,529,225 | 6/1996 | Chang | 222/391 |
| 5,615,807 | 4/1997 | Peng | 222/391 |

*Primary Examiner*—Gregory L. Huson

*Attorney, Agent, or Firm*—Royal W. Craig

[57] ABSTRACT

Simple and economical embodiments of a drip-stop resistance assembly for caulking guns incorporating a resistance clip, or alternatively, an elastic grommet or constricted spring. The drip-stop assembly may be used with various manually-operated caulking guns including those with metal enclosures and single piece molded plastic open frames, and with various types of plunger shafts including those with a circular or hexagonal cross-section, or ratchet teeth. The drip-stop assembly includes a resistance clip formed of resilient steel wire or the like, and bent or cast in the form of an annular yoke for encircling the plunger shaft and providing frictional resistance against sliding. The resistance clip may be inserted onto the plunger shaft (from above or below the housing) at various positions along the shaft. A back-plate formed by a conventional washer, or angle-bracket is inserted on the plunger shaft and is spaced from the resistance clip for allowing the latter to frictionally slide a short distance. An elastic grommet and constricted spring are also shown as substitutes for the resistance clip. All of the illustrated drip-stop assemblies provide an initial momentary release feature to terminate the bead of caulk upon initial release of the trigger, reduce blow-back, and prevent inadvertent retraction of the plunger shaft. The assemblies are all simple and inexpensive to manufacture, yet highly effective. Its simplicity allows them to be manufactured OEM or retrofit for minimal additional cost.

17 Claims, 15 Drawing Sheets

DRIPLESS DRIVE RESISTANCE CLIP FOR CAULK DISPENSING DEVICES

CROSS-REFERENCE TO RELATED APPLICATION (S)

The present invention is a continuation-in-part of U.S. Ser. No. 491,119, now U.S. Pat. No. 5,529,225 filed 16 Jun. 1995, and of Ser. No. 495,800, now U.S. Pat. No. 5,653,363, filed 27 Sept. 1995 which applications are a divisional and continuation-in-part, respectively, of Ser. No. 08/296,647, filed Aug. 26, 1994, which is a continuation-in-part of Ser. No. 205,605, now U.S. Pat. No. 5,381,931, filed Mar. 4, 1994.

FIELD OF THE INVENTION

The present invention relates to dispensing devices and, more particularly, to hand-held caulk guns having a controlled dripless drive feature to automatically relieve built-up pressure from the caulk cartridge upon initial release of the trigger.

BACKGROUND OF THE INVENTION

Conventional economy brand caulking guns are generally manual trigger-operated devices incorporating a unidirectional gripping assembly which urges a piston rod forward to eject the compound from a cartridge. One such caulk gun is set forth in U.S. Pat. No. 5,381,931 issued to the inventor named herein for his "Caulk Dispensing Device with Multi-Position Thrust Selection Dial". This patented gun allows the user to vary the leverage obtainable by a hand operated trigger, and it insures robust delivery of the composition at a selectable volume and flow rate. The improvement helps to deliver a variety of dense fluid compounds including urethane, vinyl, polyester, epoxy and other plastics or resins.

Though delivery is important, so to is the ability to quickly cut-off delivery. Many of these compounds have other properties such as fast setting times that make them difficult to remove if excessively applied. Consequently, in addition to being robust, the dispensing device must be capable of applying a clean and uniform bead of compound, and this requires tight control at all times over the volumetric flow rate. However, control has previously been lacking when the user wishes to terminate the bead of caulk. Conventional caulk guns generally maintain full pressure when the trigger is initially released, and the bead of caulk continues unabated until the pressure dissipates. This lack of control detracts from the quality of the bead. It is much better if pressure is relieved slightly upon initial release of the trigger, thereby abating the flow of caulk. On the other hand, the plunger must be quickly locked in place to prevent rearward retraction and to allow the user to continue the bead.

Certain prior art guns have incorporated rearwardly mounted release levers which, when depressed, relieve pressure to terminate the bead of caulk. However, the user must release the trigger and then depress a release lever to terminate the bead. This introduces a short lag time after the decision to terminate the bead. Within this lag time of maintained pressure, an unwanted surplus of compound is extruded and a messy and uneven bead often results. It is best if pressure is automatically released upon full release of the trigger, thereby cutting off the flow of caulk.

There have been efforts to achieve this momentary releasing action in the past. For example, U.S. Pat. No. 4,566,610 issued to Herb discloses a dual-cartridge dispensing device utilizing a pair of angled grips 16 which engage a releasing member 19 upon full release of the trigger to thereby remove all driving force and free the plunger shafts. Unfortunately, the releasing mechanism of Herb '610 is adapted for that particular drive assembly, and the drive assembly is complex and expensive.

U.S. Pat. No. 4,461,407 to Finnegan discloses an automatic pressure relief mechanism for a caulk gun including an annular elastic ring 42 tightly encircling the plunger shaft 8. The ring 42 is held against the intermediate wall 21 of the housing by a fixed retainer 200. When the trigger 130 is retracted, the plunger shaft 124 is urged forward through the ring 42. Since it is tight, the ring deforms and is partially pulled through the intermediate wall 21. When the trigger 130 is released, the deformed ring 42 tries to regain its shape, thereby pulling shaft 124 back a bit. This releases pressure, and a dripstop feature is introduced. The momentary release of pressure helps to eliminate the unwanted surplus of compound-that results in a messy and uneven bead. Also, it reduces cartridge "blow-back." Blow-back is a significant problem that occurs when unwanted pressure in the cartridge forces caulk out the back, where it gums up the plunger shaft 124 and drive mechanism. The momentary release of pressure reduces this.

U.S. Pat. No. 5,156,305 to Eyre discloses a drive assembly for a more economical molded-plastic open frame caulk gun. In this open frame type, the plunger shaft is slidably carried by two sleeves 28, 30 formed in a molded plastic housing. A downwardly extending trigger 43 is pivoted to the housing and retractable against the handle 46. The trigger 43 includes an upper rivet 45 above the pivot point. The upper rivet 45 bears against a first gripping member 41 that encircles the plunger shaft, and a compression spring 42 rearwardly biases the first gripping member 41 toward the trigger 43. A release lever 51 encircles the plunger shaft and extends upwardly behind the housing to a pivot point. Like Finnegan '407, Eyre '305 also teaches the use of a rod-engaging O-ring bush 52 that relieves pressure upon release of the trigger. In contrast to Finnegan '407, Eyre '305 attaches the bush 52 to the release lever 51 to move therewith (see, also, column 4, lines 18). The plunger shaft fictionally passes through the elastic bush 52. In operation, the release lever 51 with integral bush 52 rides forward on the plunger shaft while the trigger 43 is retracted. When the trigger 43 is first released, the friction of the bush 52 catches the plunger shaft and the release lever 51 is carried backward. The release lever 51 eventually attains a critical angle and engages the plunger shaft to prevent further retraction. However, pressure is released in the meantime, and a dripstop feature is introduced. As with Finnegan '407, Eyre '305 likewise leaves room for improvement. The bush 52 and housing 53 assembly is rather costly as it requires drilling of a hole through the release lever, insertion of the bush 52 in the housing 53, and insertion of the combination into the release lever hole. The additional parts and labor greatly increases manufacturing costs. Also, the bush 52 is subject to the same cartridge blow-back problem described above.

The present inventor has proposed his own solutions in co-pending parent application entitled "Dripless Drive Mechanisms for Caulk Dispensing Devices", Ser. No.: 08/296,647 now abandoned. In this application various mechanisms are shown which provide an initial releasing action, then an operating range (short of full release) where the plunger shaft cannot retract and pressure is maintained, and then a second release upon release of the trigger. Hence, an operator can selectively keep the trigger within the operating range to apply/maintain pressure and output a uniform bead of caulk. Alternatively, the operator can fully release the trigger to release pressure, end the bead, and stop dripping.

There remains a need for further improvements and refinements to the existing dripless drive mechanisms. Specifically, it would be greatly advantageous to provide a more economical drip-stop releasing mechanism that could be incorporated or retrofit to a wider variety of conventional caulk gun drive mechanisms.

SUMMARY OF THE INVENTION

In accordance with the above, it is an object of the present invention to provide simpler, less costly, and more efficient drive assemblies with simple economical drip-stop resistance-clips to momentarily relieve pressure upon initial release of the trigger, thereby improving control over the bead of caulk. This feature eliminates the unwanted surplus of compound that results in a messy and uneven bead, and further reduces blow-back.

It is another object to provide a drip-stop resistance-clip to relieve pressure as described above and to reduce blow-back, said resistance clip being easily replaceable to avoid clogging of the drive mechanism should blow-back occur.

It is another object to provide dripless drive assemblies incorporating a rubber grommet or constricted spring in place of the above-described resistance clip.

It is another object to provide one or more of the above-described improvements to impart a degree of restraint against the plunger shaft inadvertently sliding backward when it is released and pressure is removed, thereby eliminating a potential safety hazard in certain situations.

These and other objects are accomplished in accordance with the present invention, which encompasses various embodiments of a drip-stop resistance assembly for caulking guns. For the purpose of illustration, the resistance-clip is shown in the context of various manually-operated caulking guns including those with metal enclosures and single piece molded plastic open frames. In either context, the guns generally include a housing with a downwardly extending handle, a plunger shaft slidably supported in the housing for dispensing caulking composition, a trigger pivoted to the housing and retractable against the handle, and a drive mechanism for advancing the plunger shaft upon retraction of the trigger.

The improvement disclosed herein includes a resistance clip formed of resilient steel wire or the like, and bent or cast in the form of an annular yoke for encircling the plunger shaft and providing frictional resistance against sliding. The resistance clip is inserted onto the plunger shaft at various positions along its length and is given a limited degree of freedom to ride the plunger shaft within the frame between a forward and rearward constraint. The constraints may be provided, for example, by a wall or sleeve of the frame, and by a conventional washer, rivet, bracket or the like inserted on the plunger shaft and spaced from the resistance clip for allowing the latter to float a short distance, thereby providing the initial drip-stop feature. Compression springs may also be inserted on the plunger shaft at various positions to bias the resistance clip. The resistance provided by the clip incidentally prevents inadvertent retraction of the plunger shaft. A rubber grommet and constricted spring resistance assembly are also shown as alternatives to the resistance clip for accomplishing the same result.

All of the subsequently described configurations refine the initial momentary release feature. They are simple and inexpensive to manufacture, yet highly effective. Their simplicity allows them to be manufactured OEM or retrofit for minimal additional cost.

DETAILED DESCRIPTION OF THE PREFERRED EMBODIMENTS

Figure 1:
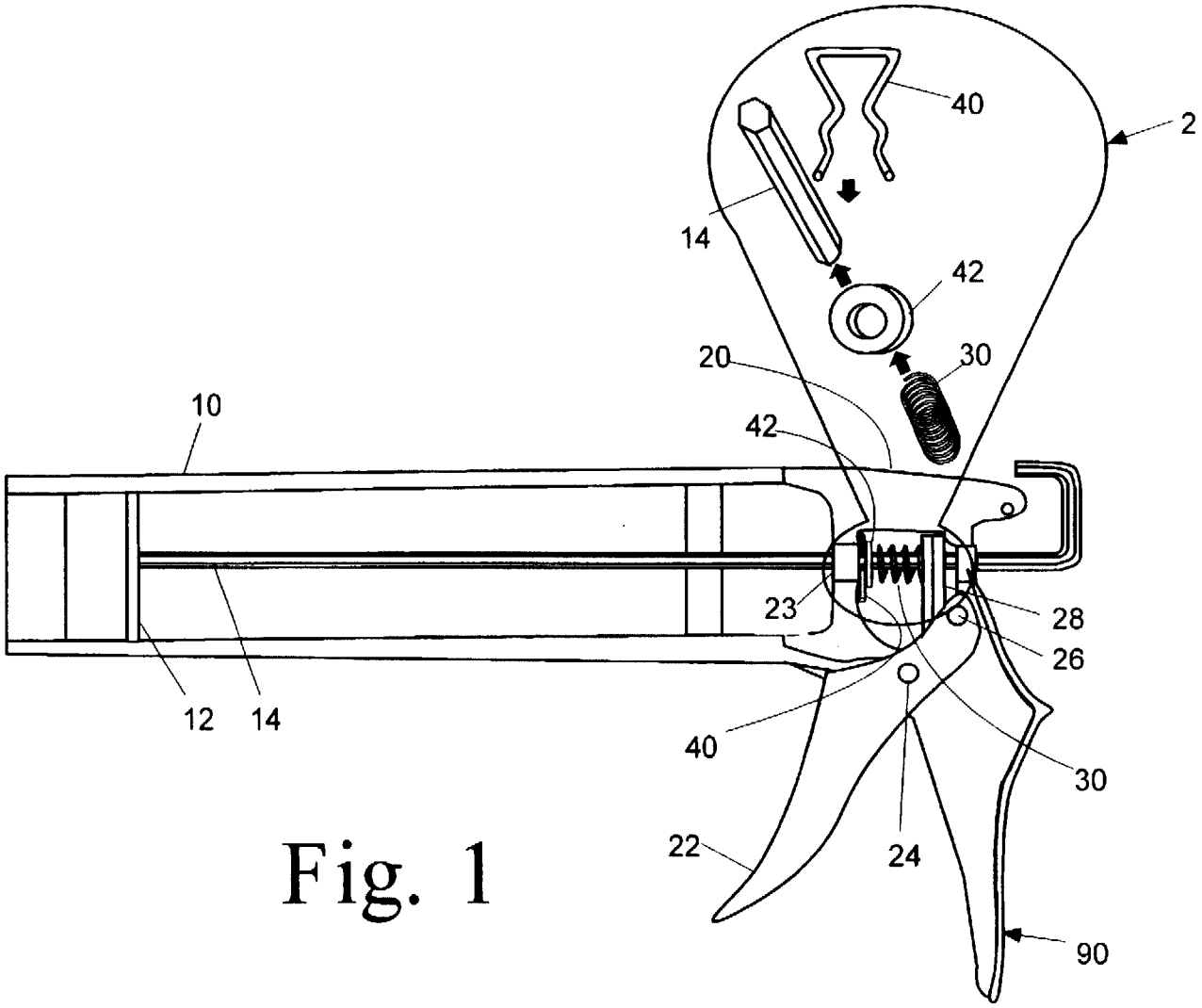
FIG. 1 is a side perspective view of a molded open-frame hand-held caulk gun with downwardly-pivoted trigger and incorporating a forwardly-mounted resistance-clip mechanism according to one embodiment of the present invention (with enlarged bubble illustration of the resistance-clip mechanism).

FIG. 1 is a side perspective view of a molded open-frame hand-held caulk gun with downwardly-pivoted trigger and incorporating a forwardly-mounted resistance-clip mechanism 2 according to one embodiment of the present invention (with enlarged bubble illustration of the resistance-clip mechanism 2).

The resistance-clip mechanism 2 is a simple and effective improvement for any caulk gun with a drip-stop feature such as shown. The illustrated caulk gun generally includes a forward frame 10 for slidably guiding a piston 12 mounted at the distal end of a plunger shaft 14. The illustrated frame is adapted for carrying a conventional caulk cartridge. Alternatively, the frame may be a refillable barrel-type reservoir for containing loose composition.

Plunger shaft 14 is carried in section 20 of the open-frame, and a trigger 22 is pivoted at a screw hinge 24 located below plunger shaft 14. A plunger drive assembly includes an enlarged upper portion of trigger 22 extending past screw hinge 24. An offset drive pin 26 extends transversely through trigger 22 and bears against a grip 28. Grip 28 may be a flat elongate metal plate having a through-bore to pass plunger shaft 14. A compression spring 30 oppositely biases the grip 28 toward the trigger 22.

The above-described components effect the forward operation of the plunger drive shaft 14. The trigger 22 is retracted by hand and pivots counterclockwise about screw hinge 24. The offset drive pin 26 bears against grip 28 and urges it forward. As grip 28 is biased forward from the bottom it reaches a critical angle where it engages plunger shaft 14, and further retraction of trigger 22 is converted into lateral movement of plunger drive shaft 14.

When trigger 22 is released it is return-biased by compression spring 30 acting through grip 28, and trigger 22 and ultimately grip 28 pivot clockwise about pivot 24 to their home position (shown). As grip 28 moves toward an upright position it releases plunger shaft 14.

As previously stated, it is desirable to momentarily slow the flow of caulk upon initial release of the trigger 22. This will give a dripless feature for improved control over the bead of caulk. In the context of the illustrated caulk gun, the dripless action is provided by the resistance-clip mechanism 2 including resistance clip 40 and a forward and rearward constraint for limiting the degree of freedom of the resistance clip 40 within the frame. In the illustrated embodiment, the rearward constraint is provided by a back-plate washer 42 in conjunction with the compression spring 30. Forward constraint is provided by the sleeve 23 of frame 20.

Resistance clip 40 is preferably formed from a length of resilient spring steel or plastic. The clip 40 is molded, bent or otherwise contoured to conform to the diameter of the plunger shaft 14. Resistance clip 40 is dimensioned to be removably clipped onto the plunger shaft 14 by pressing it with the thumb or a tool, and it exerts a degree of pressure in order to frictionally resist sliding along the shaft 14. In the illustrated embodiment, the resistance clip 40 is inserted on the plunger shaft 14 within the open section 20 directly behind a forward housing sleeve 23 (or other wall that carries plunger shaft 14). Back-plate washer 42 is carried on the plunger shaft 14 behind resistance clip 40, and compression spring 30 is carried by the plunger shaft directly behind the back-plate washer 42.

Figure 2:
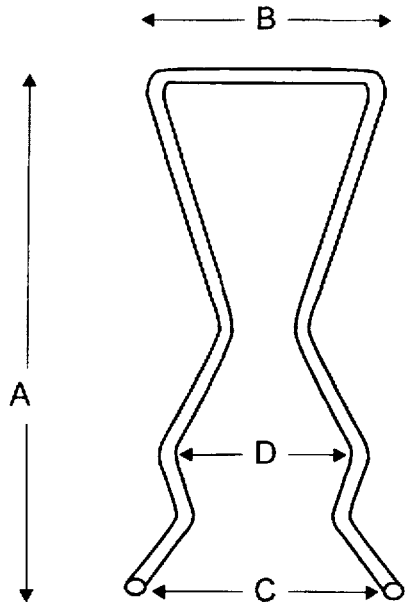
FIG. 2 is an enlarged front view of a resistance clip according to the present invention.
Figure 3:
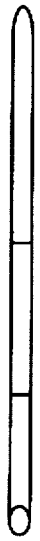
FIG. 3 is an enlarged side view of the resistance-clip of FIG. 2.

FIG. 2 is an enlarged front view of a resistance clip 40 as shown in FIG. 1, and FIG. 3 is an enlarged side view of the same resistance clip 40. Resistance clip 40 should be dimensioned so as not to interfere with operation of the drive mechanism. It has been found that a resistance clip 40 having a maximum 3 mm diameter and being formed of high carbon spring steel in accordance with the following dimensions (in respect to FIG. 2) works very well.

| | A | B | C | D |
|---|---|---|---|---|
| Maximum Dimension (mm) | 40 | 20 | 14 | 7 |

In addition, the resistance clip 40 may be surface treated or coated with resin or plastic to smooth the friction. The free ends of resistance clip 40 are flared outwardly to ease insertion onto the plunger shaft 14. It is also noteworthy that clip 40 can be bent as desired to conform to the interior of the housing.

Figure 3A:
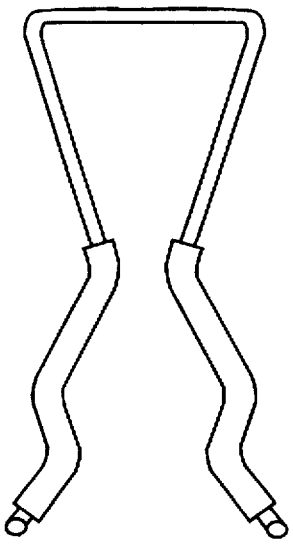
FIG. 3A illustrates optional rubber sleeves which may be inserted over the ends of the resistance clip to improve its frictional properties.

FIG. 3A illustrates optional plastic sleeves which may be inserted over the ends of the resistance clip to improve its frictional properties. The sleeves are formed from commercially available heavy-gauge plastic tubing such as used for wire insulation purposes. These sleeves serve to smooth the frictional resistance properties of the clip.

Figure 4:
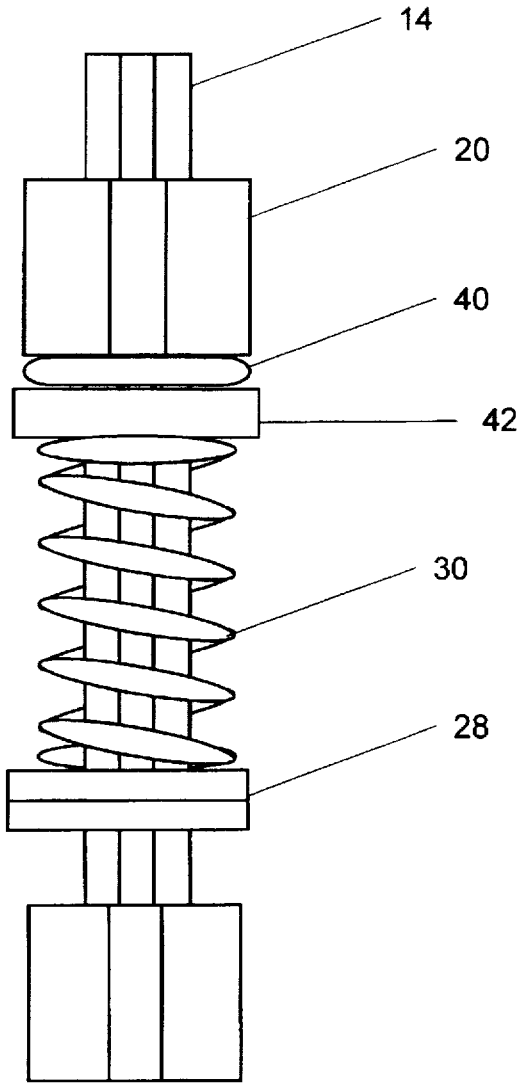
FIG. 4 is a top cut-away view of the resistance clip mechanism of FIG. 1.

FIG. 4 shows a top cut-away view of the resistance clip mechanism of FIG. 1.

Back-plate washer 42 may be any conventional round or square washer or other plate, preferably having a maximum thickness of 4 mm, and having a through-bore sized to allow it to slide freely along the plunger shaft 14. Spring 30 may be a conventional spring of having an approximate 35 mm length, and the thickness of grip 28 is approximately 12 mm. Of course, these dimensions may vary in accordance with the size of the open section 20 and the desired degree of freedom of resistance clip 40.

In forward operation, the trigger 22 is retracted and drive pin 26 biases and angles grip 28 until it attains a critical angle and grips plunger shaft 14. Grip 28 then drives plunger shaft 14 forward. This in turn carries the resistance clip 40 which maintains a limited degree of frictional pressure on plunger shaft. Clip 40 rides forward on the plunger shaft as trigger 22 is retracted until clip 40 becomes lodged against the forward sleeve 23. Compression spring 30 becomes compressed as plunger shaft 14 continues to slide through the resistance clip 40. The degree of friction maintained by clip 40 is calculated so as not to unduly obstruct forward movement of the plunger shaft 14. The proper friction can be controlled by adjusting the thickness and dimensions of the resistance clip 40.

Upon release of trigger 22, the grip 28 moves backward and compression spring 30 recoils. The recoiling spring 30 releases the grip 28 and provides limited initial release of the plunger shaft 14, thereby momentarily relieving pressure within the caulk cartridge.

When the bias imparted by the recoiling spring 30 is sufficiently reduced, the resistance clip 40 again frictionally grips plunger shaft 14 and rides backward thereon. Resistance clip 40 continues to ride backward pushing back-plate washer 42 along. The plunger shaft 14 retracts until the grip 28 attains its original upright position. At this point, back-plate washer 42 is stopped by compression spring 30, which in turn stops the resistance clip 40, which maintains its frictional grip and engages said plunger shaft to prevent further retraction.

The relief of pressure upon initial release of the trigger momentarily slows and stops the flow of caulk and gives greater control over the bead. Consequently, a dripless feature is provided by momentarily removing pressure from within the caulk cartridge, thereby cutting off the flow of caulk. This feature reduces blow-back. Moreover, if blow-back does occur, the resistance-clip can be easily removed for cleaning and/or replaced with a fresh clip to avoid fouling that may otherwise clog the drive mechanism. Upon full release the plunger remains locked in place by resistance clip 40 and is always held against loose sliding within the housing. This eliminates a safety hazard in certain situations. For instance, a typical 11 oz caulk cartridge weighs approximately 1 lb. Caulk guns loaded with such a cartridge are often carried by the hooked plunger shaft (or the gun may be hung thereby from a ladder or belt). In such case, the user needs the plunger shaft 14 to remain fixed. Otherwise, the shaft 14 might slide free into the user's face, possibly knocking them from a ladder or otherwise causing injury. This requires a certain degree of resistance by the plunger shaft 14. The illustrated resistance clip 40 resists approximately 1–1.5 lbs of force and serves to reduce the above-described safety hazard without unduly restricting forward operation. To further reduce the safety hazard, a rubber grommet may be used in place of or in conjunction with the spring clip 40 (as will be further described).

Figure 5:
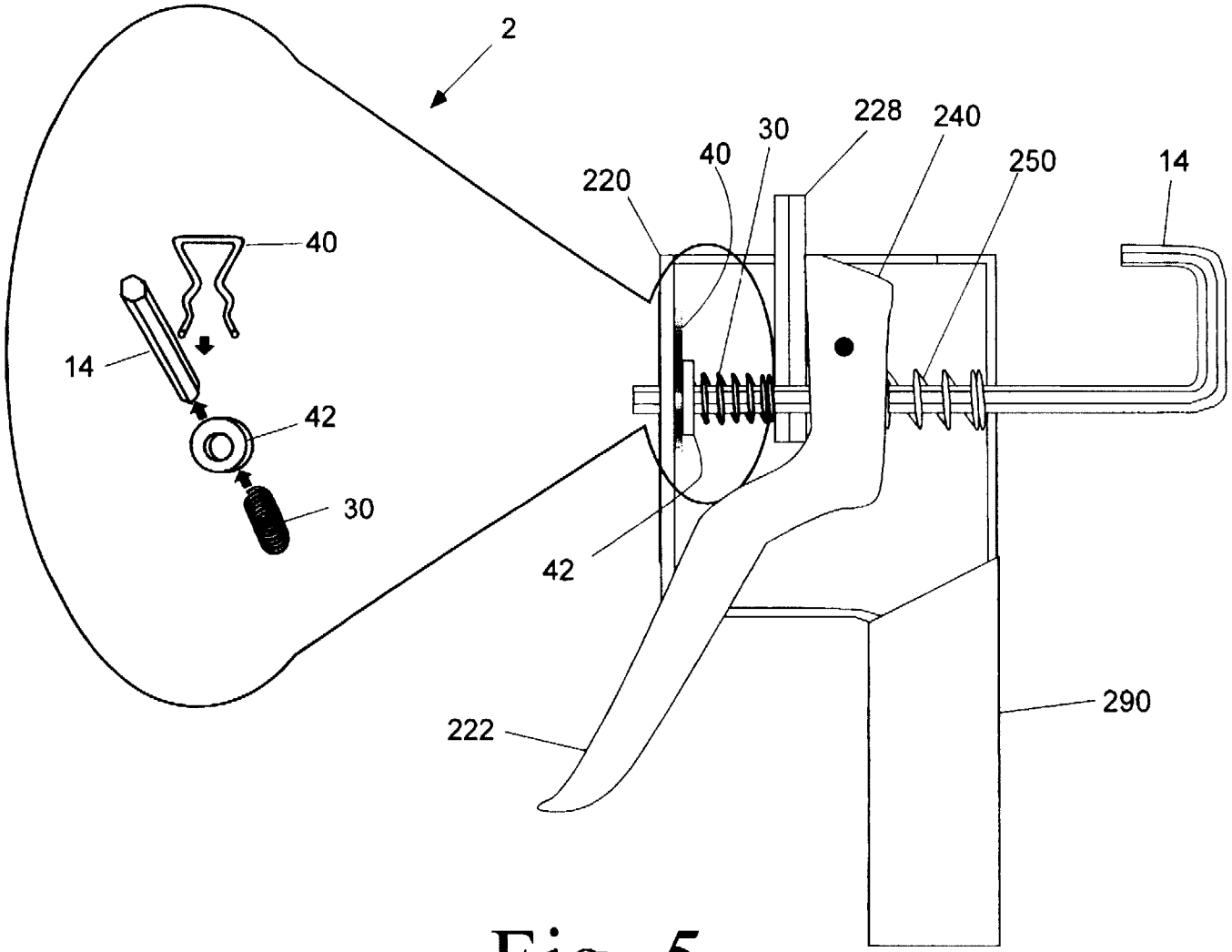
FIG. 5 is a side cut-away view of a metal closed-frame hand-held caulk gun with upwardly-pivoted trigger and incorporating a forwardly-mounted resistance-clip mechanism according to another embodiment of the present invention (with enlarged bubble illustration of the resistance-clip mechanism).
Figure 6:
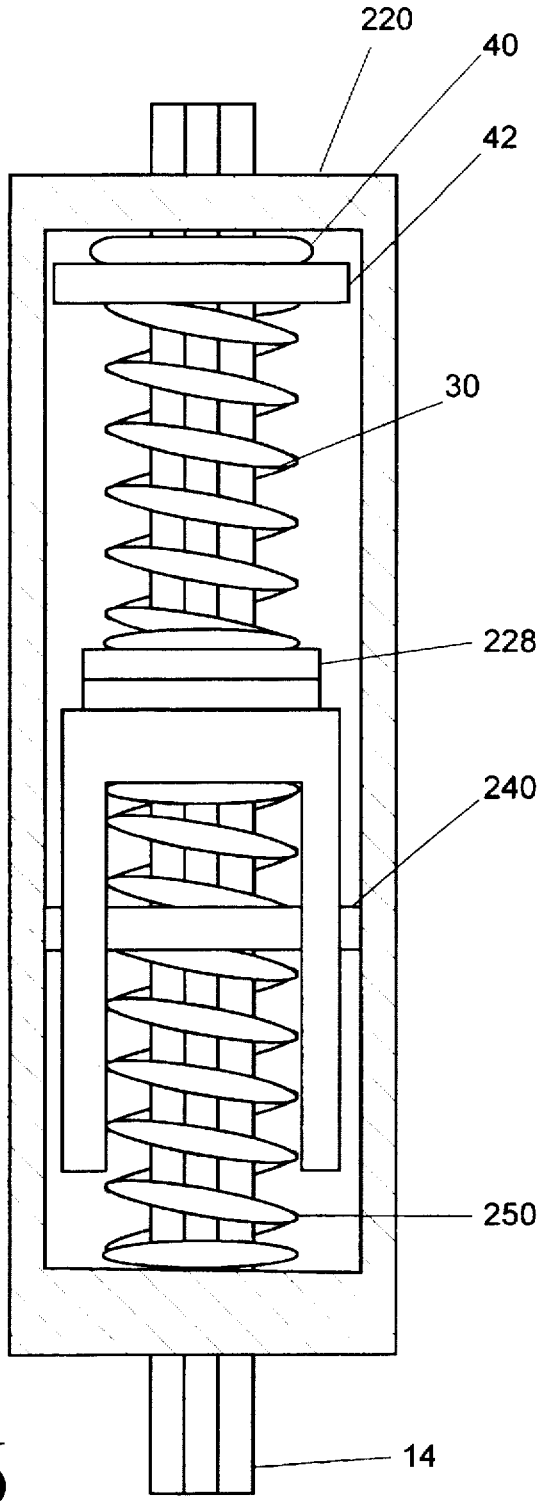
FIG. 6 is a top view of the resistance clip mechanism of FIG. 5.

FIG. 5 is a side perspective view and FIG. 6 a top view of a metal closed-frame hand-held caulk gun with upwardly-pivoted trigger and incorporating a forwardly-mounted resistance-clip mechanism similar to that shown in FIGS. 1–4. In this embodiment, plunger shaft 14 is carried in a closed frame housing 220, and a trigger 222 is pivoted at a screw hinge 240 located above plunger shaft 14. An enlarged upper portion of trigger 222 extends past screw hinge 240. The enlarged upper portion bears directly against a grip 228. Grip 228 may again be a flat elongate metal plate having a through-bore toward its lower end to pass plunger shaft 14. The forward compression spring 30 oppositely biases the grip 228 toward the trigger 222. A second compression spring 250 mounted on the plunger shaft 14 directly behind trigger 222 forwardly biases the trigger 222 in a clockwise direction.

In forward operation, the trigger 222 is retracted by hand and pivots counterclockwise about screw hinge 240. The top edge of the upper portion of trigger 222 bears against grip 228 and urges it forward. As grip 228 is biased forward from the top it becomes more angled. Eventually grip 228 attains a critical angle where it engages plunger shaft 14, and further retraction of trigger 222 is converted into lateral movement of plunger drive shaft 14.

The same resistance-clip mechanism is used, and resistance clip 40 may be removably clipped onto the plunger shaft 14 by insertion through the top of housing 220. Once again, resistance clip 40 maintains a limited degree of frictional pressure on plunger shaft 14. Clip 40 rides forward on the plunger shaft as trigger 22 is retracted until it becomes lodged against the forward constraint of housing 220. Compression spring 30 becomes compressed, but plunger shaft 14 continues to slide through resistance clip 40.

Upon release, trigger 222 is return-biased by compression springs 30 and 250 and pivots clockwise about pivot 240 toward its home position. The forward bias is removed from grip 228, and grip 228 moves backward allowing compression spring 30 to recoil. The recoiling spring 30 provides limited initial release of the plunger shaft 14, and momentarily relieves pressure on the caulk cartridge. When the bias imparted by the recoiling spring 30 is sufficiently reduced, the resistance clip 40 again frictionally grips plunger shaft 14 and rides backward thereon. Resistance clip 40 continues to ride backward pushing back-plate washer 42 along. The plunger shaft 14 retracts until the grip 28 attains its original upright position. At this point, back-plate washer 42 is rearwardly constrained by compression spring 30. This in turn stops the resistance clip 40, which maintains its frictional grip and engages said plunger shaft to prevent further retraction. Consequently, the same dripless feature is provided by momentarily removing pressure from the caulk cartridge, and the plunger shaft 14 is safely held against loose sliding within the housing.

Figure 7:
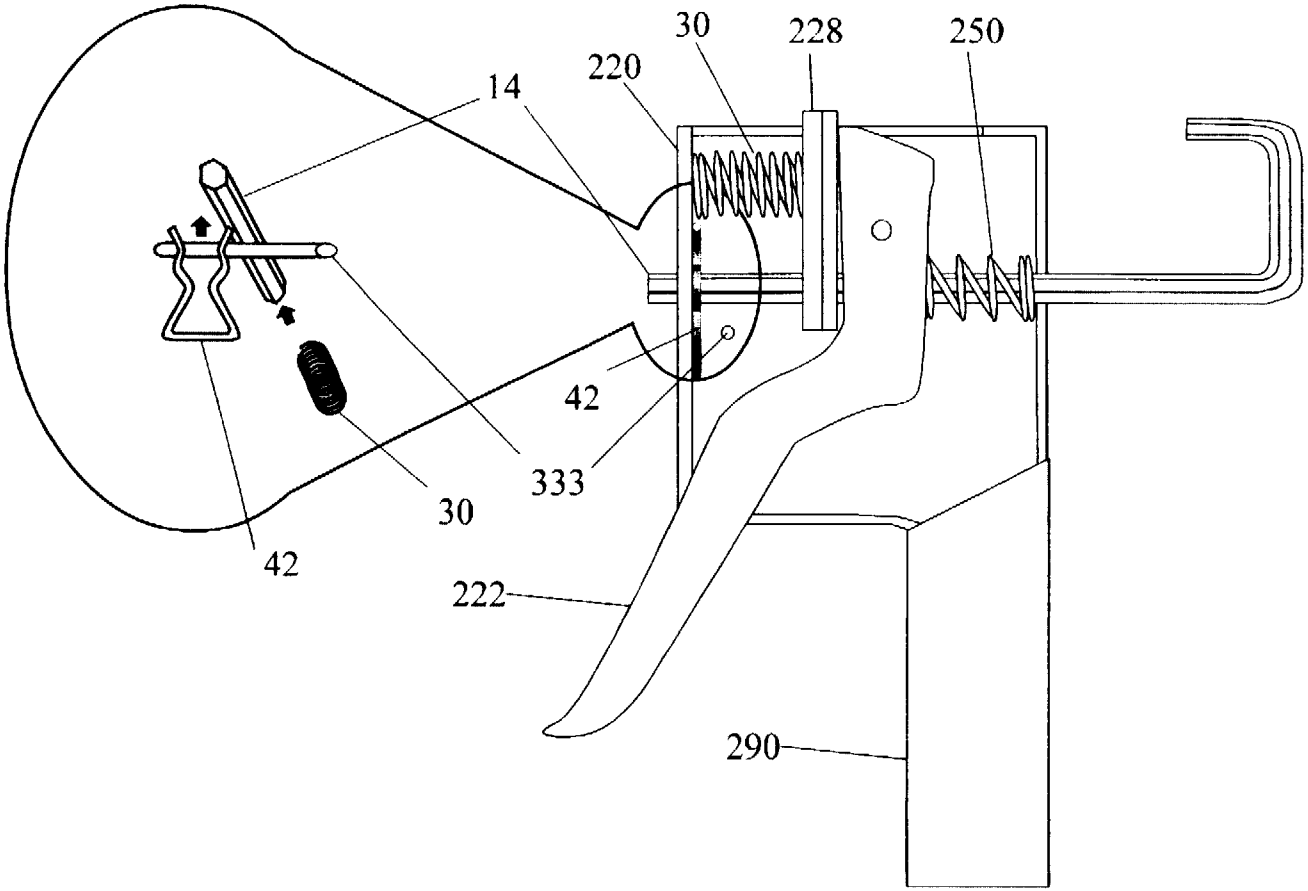
FIG. 7 is a side cut-away view of a metal closed-frame hand-held caulk gun with upwardly-pivoted trigger and incorporating a forwardly-mounted resistance-clip mechanism as in FIG. 5, but with a lateral rivet 333 replacing the back-plate washer 42.
Figure 8:
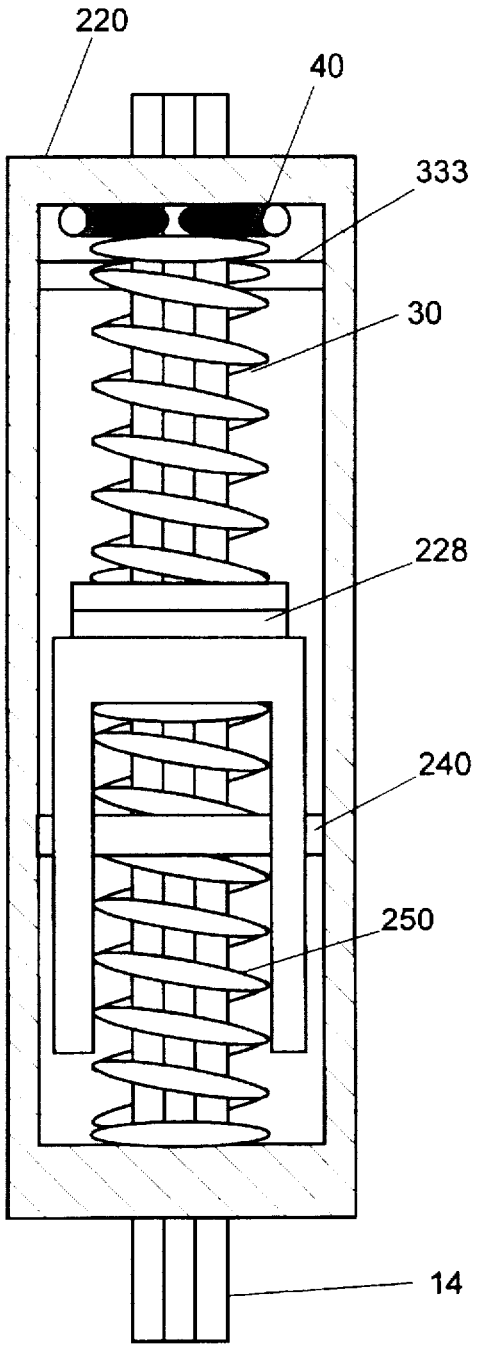
FIG. 8 is a top view of the resistance clip mechanism of FIG. 7.

FIG. 7 is a side perspective view and FIG. 8 a top view of a metal closed-frame hand-held caulk gun similar to that shown in FIGS. 5 and 6 with the exception that a transverse rivet 333 is substituted for the back-plate washer 42. Also, compression spring 30 is elevated above the plunger shaft 14.

The same resistance-clip 40 is used to maintain a limited degree of frictional pressure on plunger shaft 14, although resistance clip 40 is here more easily inserted onto plunger shaft 14 from below and is carried thereon upside down.. Transverse rivet 333 spans the side-walls of the housing 220 at a position spaced slightly behind the front wall and above (or below) the plunger shaft 14. Forward operation is identical with clip 40 riding forward on the plunger shaft as trigger 22 is retracted until it becomes lodged against the housing 220. Compression spring 30 becomes compressed, but plunger shaft 14 continues to slide through resistance clip 40.

Release is also similar except that the resistance clip 40 grips plunger shaft 14 and rides backward thereon until it is stopped by transverse rivet 333. Resistance clip 40 maintains its frictional grip and engages said plunger shaft to prevent further retraction. Consequently, the same dripless feature is provided by momentarily removing pressure from the caulk cartridge, and the plunger shaft 14 is safely held against loose sliding within the housing. The transverse rivet 333 is in all cases a convenient alternative to the back-plate washer 42.

Figure 9:
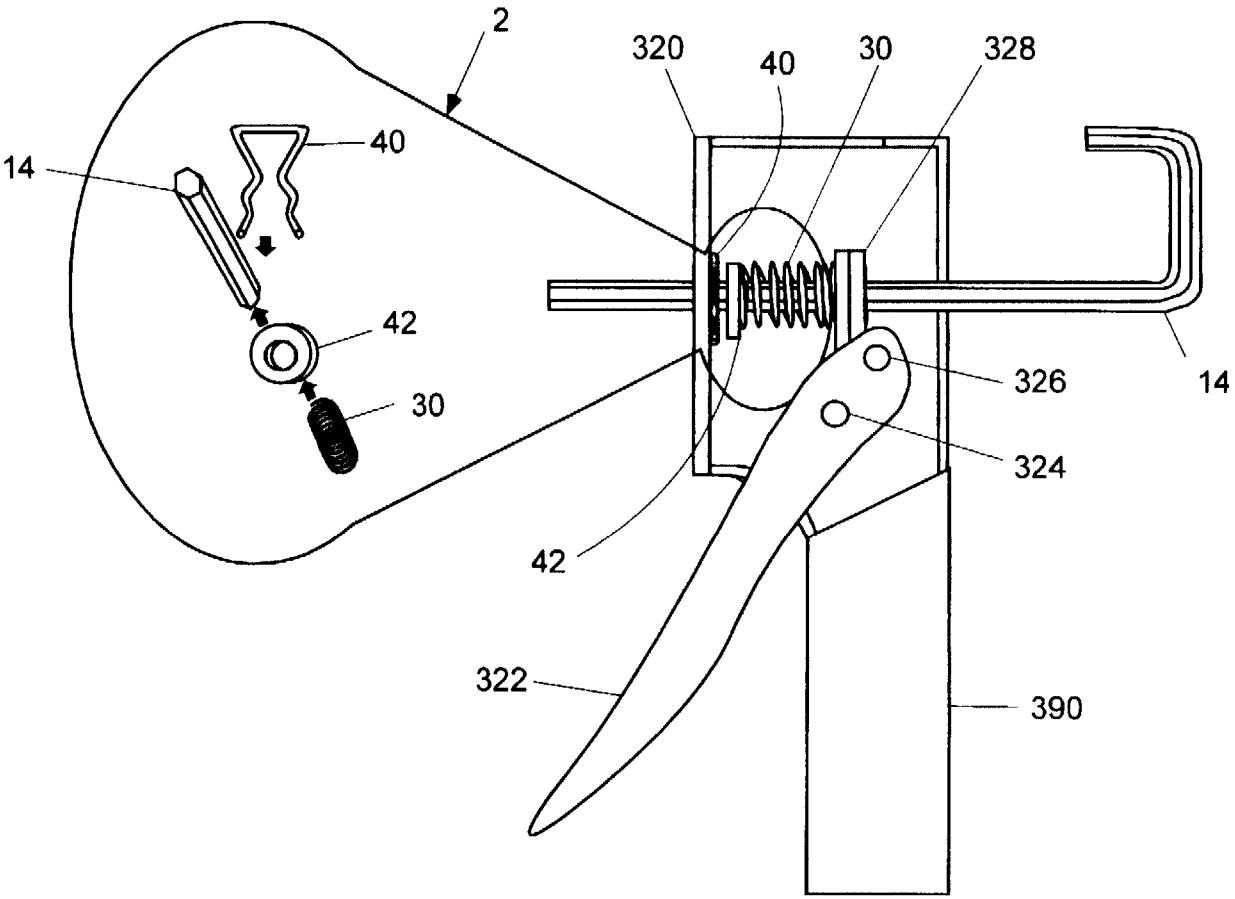
FIG. 9 is a side cut-away view of a metal closed-frame hand-held caulk gun with downwardly-pivoted trigger and incorporating a forwardly-mounted resistance-clip mechanism according to one embodiment of the present invention (with enlarged bubble illustration of the resistance-clip mechanism).

FIG. 9 is a side perspective view of a metal closed-frame hand-held caulk gun with downwardly-pivoted trigger and incorporating a forwardly-mounted resistance-clip mechanism 2 (with enlarged bubble illustration of the resistance-clip mechanism). Plunger shaft 14 is carried in a closed frame housing 320, and a trigger 322 is pivoted at a screw hinge 324 located below plunger shaft 14. An enlarged upper portion of trigger 322 extends past screw hinge 324. An offset drive pin 326 extends transversely through trigger 322 and bears against a grip 328. Grip 328 is again a flat elongate metal plate having a through-bore to pass plunger shaft 14. Compression spring 30 oppositely biases the grip 328 toward the trigger 322.

Forward operation of the plunger drive shaft 14 is accomplished in substantially the same manner as described with regard to the foregoing embodiments. Rearward operation is also the same, and the resistance clip 40, back-plate washer 42 and compression spring 30 serve to momentarily slow the flow of caulk upon initial release of the trigger 322. This give the same dripless feature for improved control over the bead of caulk. The resistance clip 40 is inserted on the plunger shaft 14 within the housing 320 directly behind the forward wall. Back-plate washer 42 is inserted onto the plunger shaft 14 behind resistance clip 40, and compression spring 30 is carried by the plunger shaft directly behind the back-plate washer 42.

Figure 10:
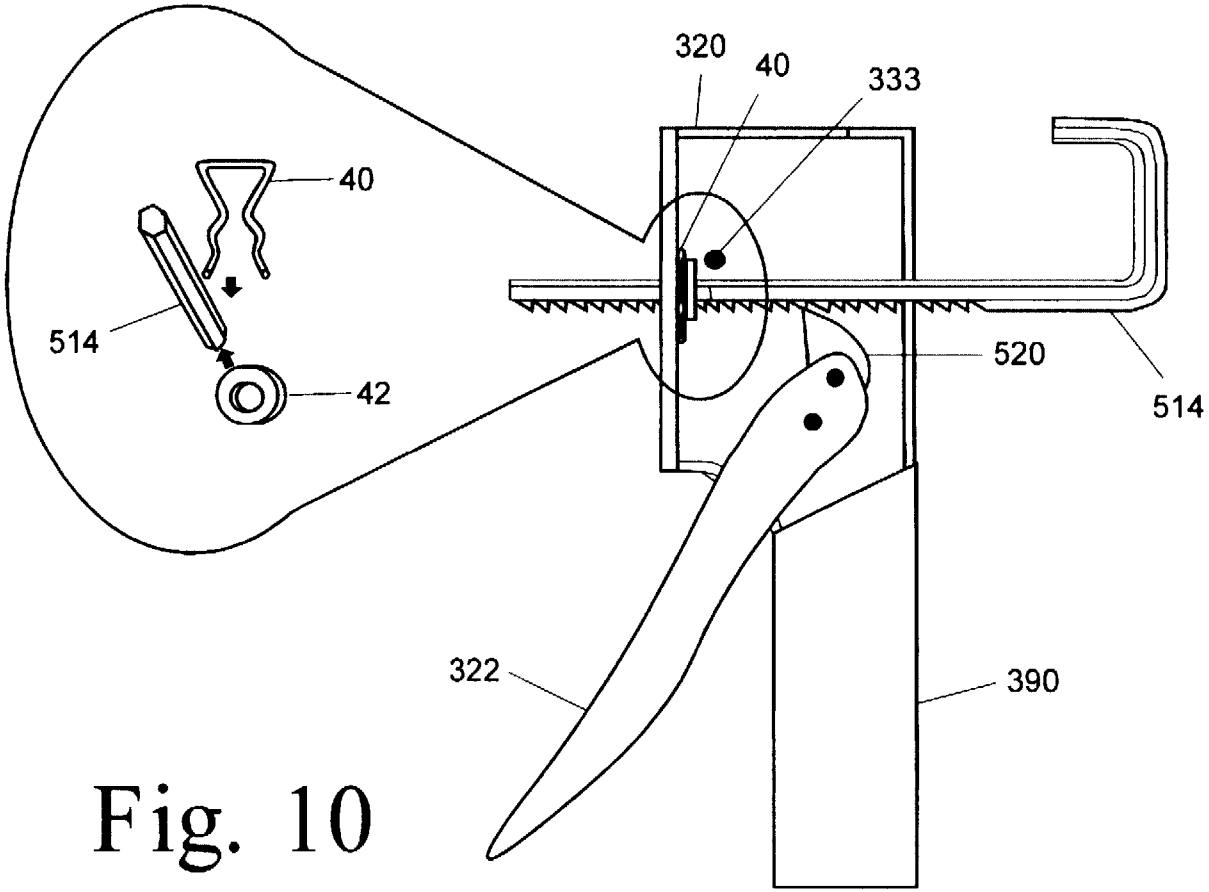
FIG. 10 is a side cut-away view of a closed-frame ratchet-drive caulk gun with downwardly-pivoted trigger and incorporating a forwardly-mounted resistance-clip mechanism according to another embodiment of the present invention (with enlarged bubble illustration of the resistance-clip mechanism).

FIG. 10 is a side perspective view of a ratchet-driven closed-frame caulk gun with downwardly-pivoted trigger and incorporating a rearwardly-mounted resistance-clip mechanism according to another embodiment of the present invention (with enlarged bubble illustration of the resistance-clip mechanism).

The embodiment of FIG. 10 is similar to that shown in FIG. 9, but incorporates a known ratchet-type drive. Also, transverse rivet 333 is used in place of back-plate washer 42. The ratchet drive is accomplished with a ratcheted plunger shaft 514, and a ratchet bit 520 pivotally mounted to the upper portion of trigger 322. The ratchet bit 520 engages drive shaft 514 during forward operation, but does not engage during rearward operation. This eliminates the need for compression springs and grips). The drip-stop releasing action of the resistance-clip mechanism (including back-plate washer 42 and resistance clip 40) is essentially the same as shown and described with regard to FIG. 9, and the need for a compression spring is eliminated. The mechanism is shown in this context to illustrate its effectiveness on various types and shapes of plunger shafts. The same resistance clip 40 can be used on plunger shafts having circular or hexagonal cross-sections, or with ratcheted shafts as shown. This alleviates a common problem with prior art drip-stop mechanisms which conform to only one specific shape of the shaft.

Figure 11:
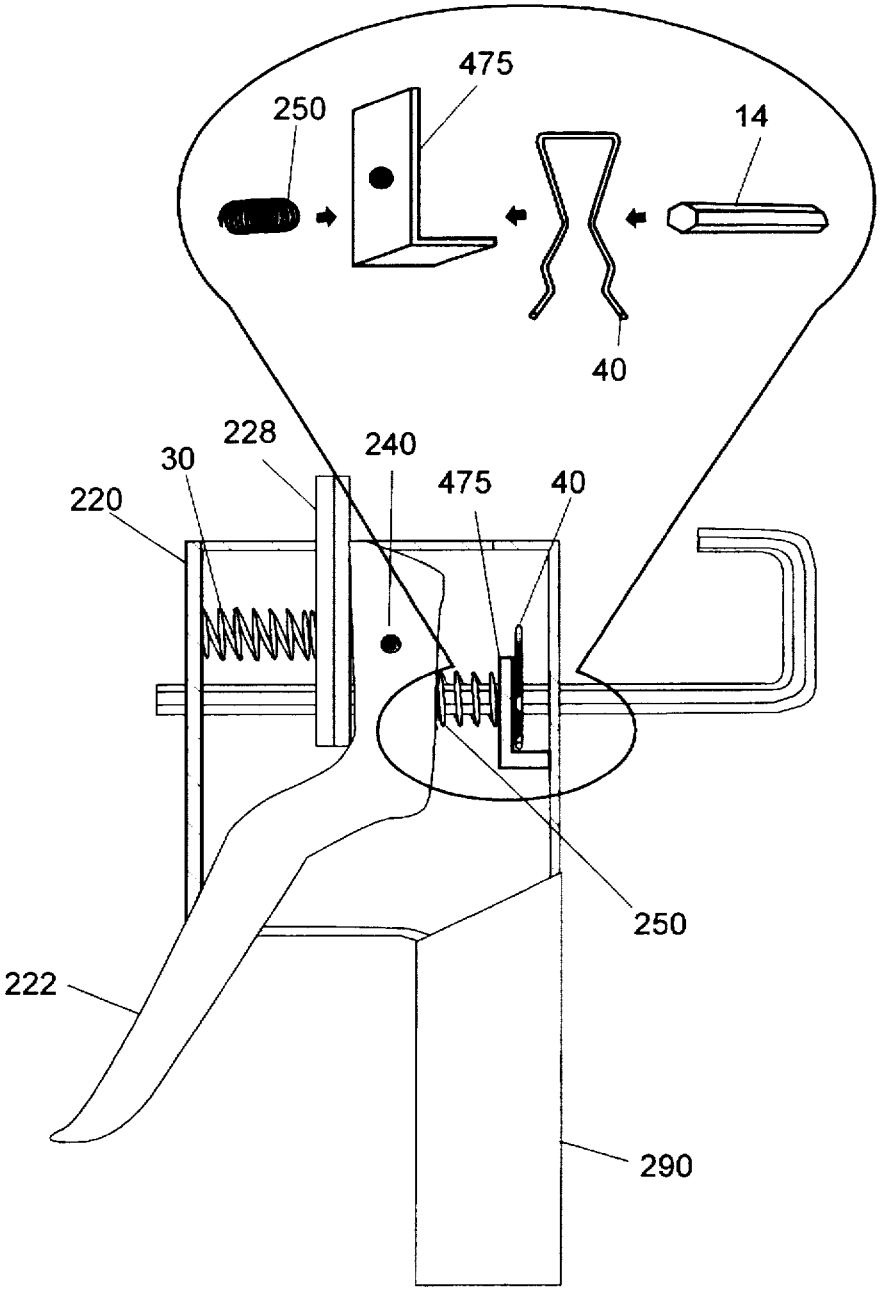
FIG. 11 is a side cut-away view of a metal closed-frame hand-held caulk gun with upwardly-pivoted trigger and incorporating a rearwardly-mounted resistance-clip mechanism according to another embodiment of the present invention (with enlarged bubble illustration of the resistance-clip mechanism).
Figure 12:
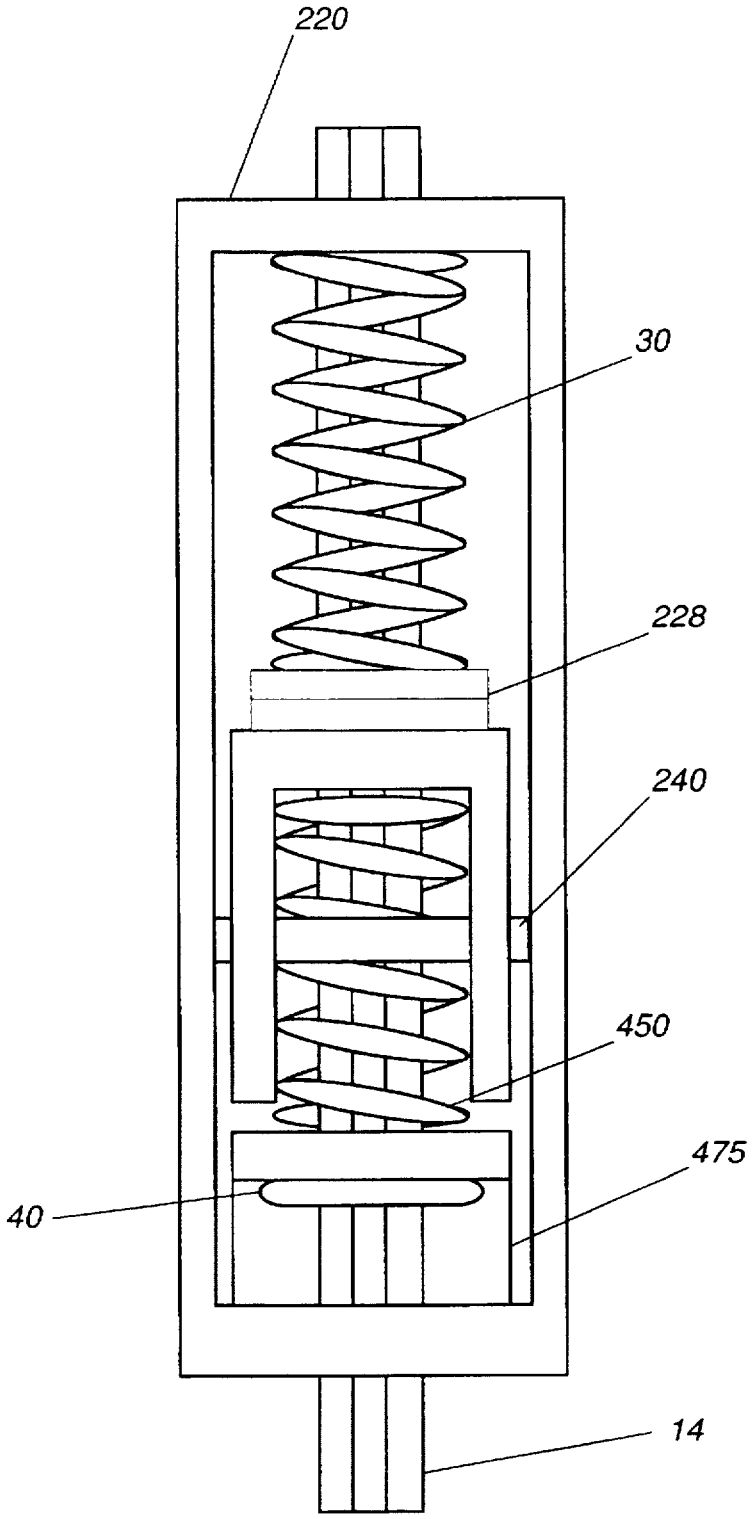
FIG. 12 is a top view of the resistance clip mechanism of FIG. 11.
Figure 13:
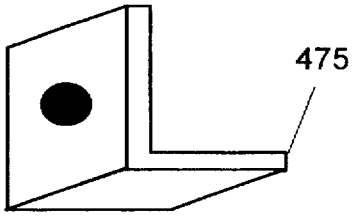
FIG. 13 is a perspective view of a rearward bracket 475 as used in the embodiment of FIGS. 11 and 12.

FIG. 11 is a side cut-away view of a metal closed-frame hand-held caulk gun with upwardly-pivoted trigger, and is provided to illustrate a rearward-mounting for the resistance-clip mechanism according to another embodiment of the present invention (with enlarged bubble illustration of the resistance-clip mechanism). FIG. 12 is a top view of the resistance clip mechanism of FIG. 11. In this case, an angle-bracket 475 is provided to effect proper operation. FIG. 13 is an exploded perspective drawing of the angle-bracket 475 which is formed of a simple right-angled metal or plastic bracket formed with a through-bore in one section to pass plunger shaft 14. The angle-bracket 475 is bonded to the rear wall of housing 220 such that the plunger shaft 14 is free to slide through the through-bore. Resistance clip 40 is clipped onto the plunger shaft 14 behind the angle-bracket 475, and the bracket poses no overhead obstruction to allow for convenient insertion of resistance clip 40 in through the top of housing 220.

In forward operation, the trigger 222 is retracted by hand and pivots counterclockwise about screw hinge 240. The top edge of the upper portion of trigger 222 bears against grip 228 and urges it forward. As grip 228 is biased forward from the top it becomes more angled. Eventually grip 228 attains a critical angle where it engages plunger shaft 14, and further retraction of trigger 222 is converted into lateral movement of plunger drive shaft 14. Resistance clip 40 maintains a small degree of frictional pressure on plunger shaft 14. Clip 40 rides forward on the plunger shaft as trigger 222 is retracted until it becomes lodged against the angle-bracket 475, and plunger shaft 14 continues to slide through the angle-bracket 475 and resistance clip 40.

Upon release, trigger 222 is return-biased by compression springs 30 and 250 and pivots clockwise about pivot 240 toward its home position. The forward bias is removed from grip 228, and grip 228 moves backward allowing compression springs 30 and 250 to recoil. The resistance clip 40 grips plunger shaft 14 and rides backward thereon until it is rearwardly constrained by the rear wall of housing 220. This freedom provides limited initial release of the plunger shaft 14, and momentarily relieves pressure on the caulk cartridge. When the resistance clip 40 is stopped by the rear wall of housing 220, its frictional grip maintains engagement with the plunger shaft 14 to prevent further retraction. Consequently, the same dripless feature is provided by momentarily removing pressure from the caulk cartridge, and the plunger shaft 14 is safely held against loose sliding within the housing.

It should be noted that angle bracket 475 may alternatively be mounted externally (protruding behind the rear wall of housing 220). This manner of mounting achieves the same operation and facilitates insertion of the clip 40 onto the plunger shaft 14.

Figure 14:
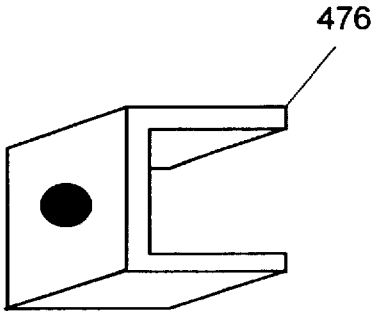
FIG. 14 is a perspective view of an alternative rearward bracket 476 which can be used in the embodiment of FIGS. 11 and 12.

FIG. 14 is an exploded perspective drawing of an alternative angle-bracket 476 which may be substituted for bracket 475. Bracket 476 is formed of a simple double-angled metal or plastic bracket formed with a through-bore in its mid-section to pass plunger shaft 14. The angle-bracket 476 is bonded at the sides to the rear wall of housing 220 such that the plunger shaft 14 is free to slide through the through-bore. It is preferable to orient the double-angled bracket such that resistance-clip 40 extends unobstructed upward and downward, and may be inserted onto plunger shaft 14 from overhead. Again, angle bracket 476 may alternatively be mounted externally (protruding behind the housing 220).

Figure 15:
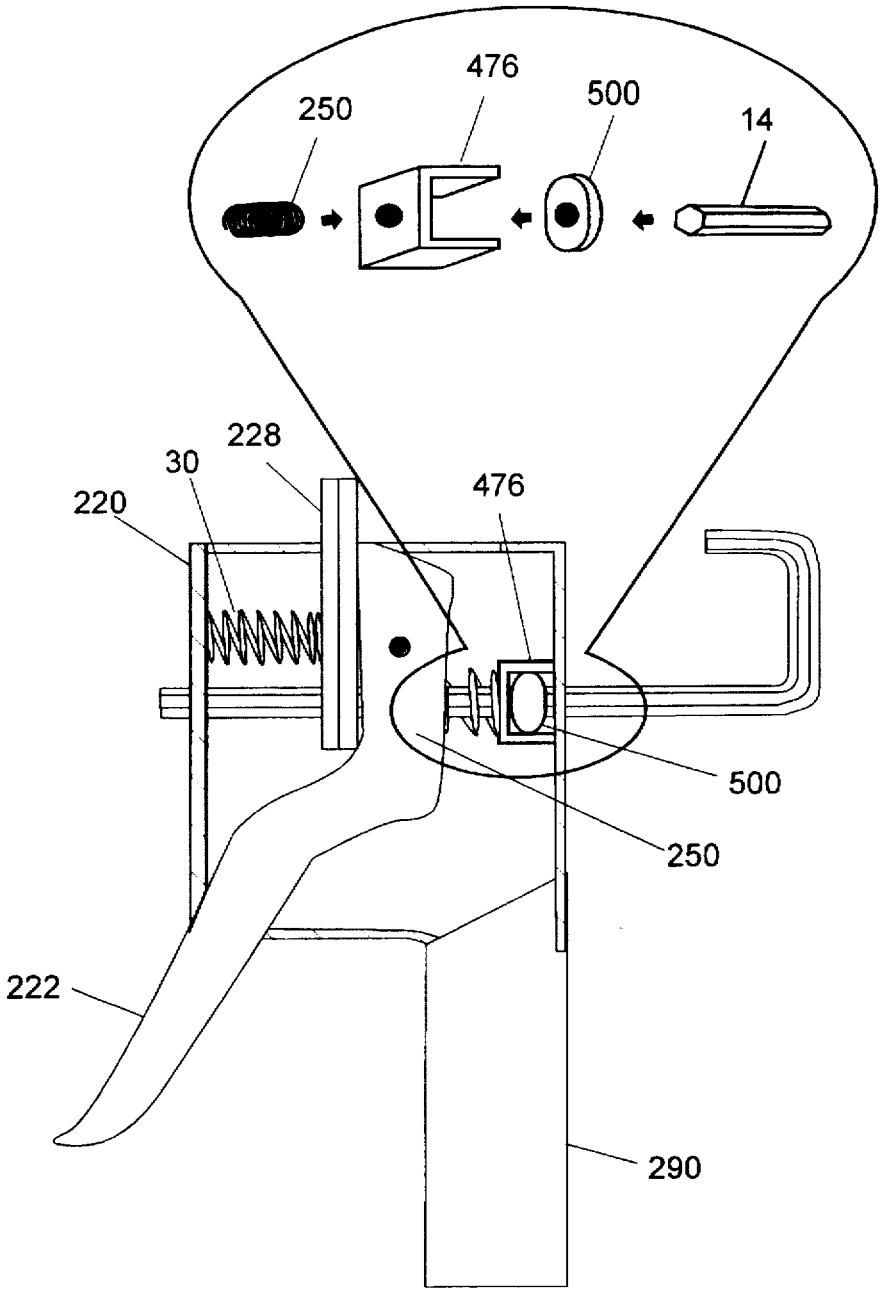
FIG. 15 is a side cut-away view of a metal closed-frame hand-held caulk gun with upwardly-pivoted trigger and incorporating a rearwardly-mounted rubber grommet 500 in place of the resistance-clip according to another embodiment of the present invention (with enlarged bubble illustration of the bracket 476 and grommet 500).

FIG. 15 is a side cut-away view of a metal closed-frame hand-held caulk gun with upwardly-pivoted trigger, and incorporating an elastic grommet 500 in place of resistance clip 40 to accomplish a like purpose. The elastic grommet 500 is preferably formed in the shape of a washer from any suitable resilient material such as rubber. Elastic grommet 500 is inserted onto the plunger shaft 14 behind angle-bracket 476 within the cavity formed thereby.

In forward operation, the trigger 222 is retracted by hand and pivots counterclockwise about screw hinge 240. The top edge of the upper portion of trigger 222 bears against grip 228 and urges it forward. As grip 228 is biased forward from the top it becomes more angled. Eventually grip 228 attains a critical angle where it engages plunger shaft 14, and further retraction of trigger 222 is converted into lateral movement of plunger drive shaft 14. Elastic grommet 500 maintains a small degree of frictional pressure on plunger shaft 14. Grommet 500 rides forward on the plunger shaft as trigger 222 is retracted until it becomes lodged against the angle-bracket 476, and plunger shaft 14 continues to slide through the angle-bracket 475 and grommet 500.

Upon release, trigger 222 is return-biased by compression springs 30 and 250 and pivots clockwise about pivot 240 toward its home position. The forward bias is removed from grip 228, and grip 228 moves backward allowing compression springs 30 and 250 to recoil. The elastic grommet 500 grips plunger shaft 14 and rides backward thereon until it is rearwardly constrained by the rear wall of housing 220. This freedom provides limited initial release of the plunger shaft 14, and momentarily relieves pressure on the caulk cartridge. When the elastic grommet 500 is constrained by the rear wall of housing 220, its frictional grip maintains engagement with the plunger shaft 14 to prevent further retraction. Consequently, the same dripless feature is provided by momentarily removing pressure from the caulk cartridge, and the plunger shaft 14 is safely held against loose sliding within the housing.

Again, angle bracket 476 and grommet 500 may alternatively be mounted externally (protruding behind the housing 220).

It should also be noted that the elastic grommet 500 may be included in addition to the resistance clip 40 described in any of the preceding embodiments to increase the resistance against loose sliding of the plunger shaft 14. In such case, elastic grommet 500 may be fixed either inside or outside of housing 220 (no lateral freedom is required) as the momentary relief of pressure necessary for the dripless feature will be provided by the resistance clip.

Figure 16:
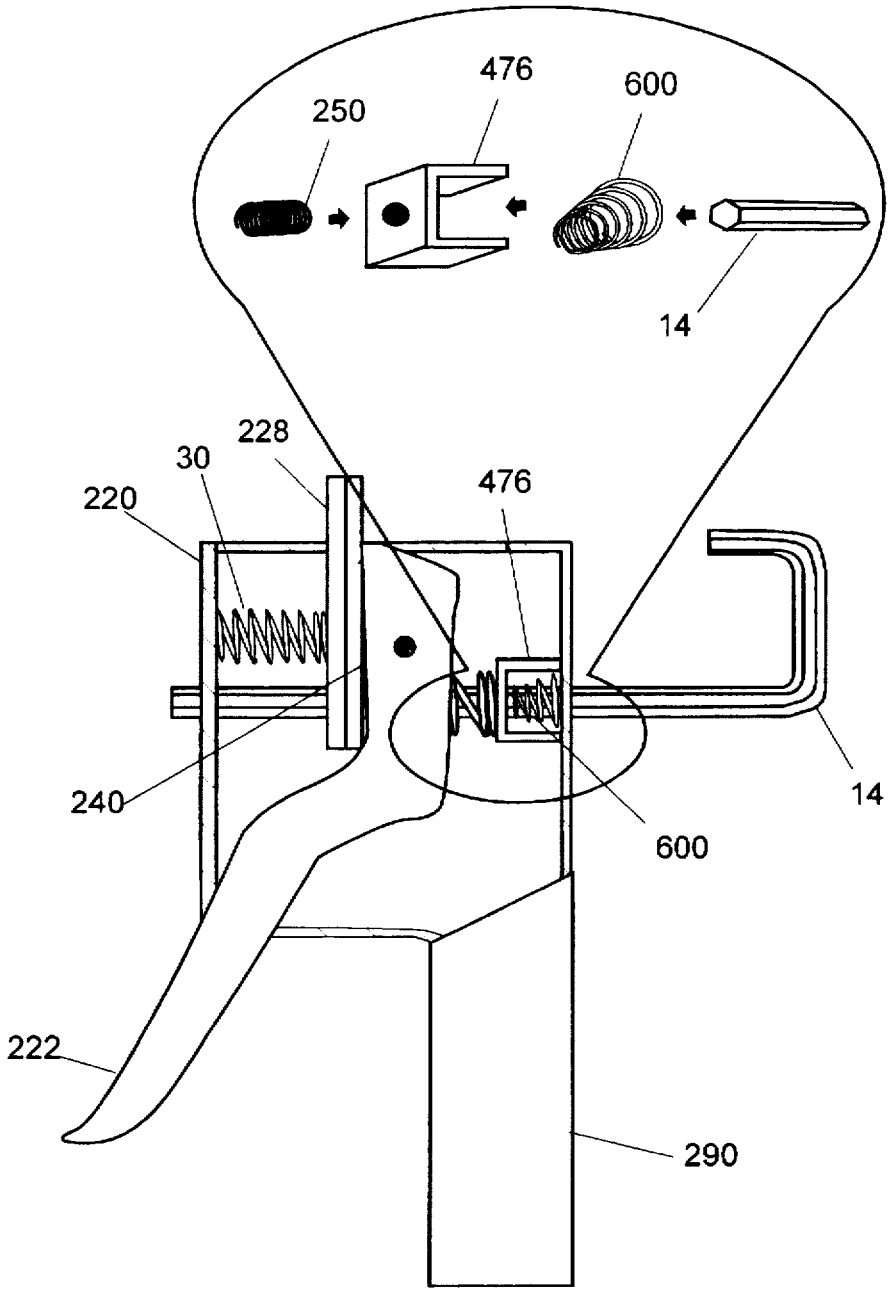
FIG. 16 is a side cut-away view of a metal closed-frame hand-held caulk gun with upwardly-pivoted trigger and incorporating a rearwardly-mounted constricted spring 600 in place of the resistance-clip according to another embodiment of the present invention (with enlarged bubble illustration of the bracket 476 and constricted spring 600).

FIG. 16 is a side cut-away view of a metal closed-frame hand-held caulk gun with upwardly-pivoted trigger as in FIG. 15, and incorporating a constricted spring 600 in place of elastic grommet 500 (or resistance clip 40) to accomplish a like purpose. The constricted spring 600 is preferably formed with progressively constricted coils from any suitable resilient material such as high carbon spring steel. The coils are constricted to grip plunger shaft 14 and impart a similar degree of frictional resistance against sliding. Constricted spring 600 is inserted onto the plunger shaft 14 behind angle-bracket 476 within the cavity formed thereby.

In forward operation, the trigger 222 is retracted by hand and pivots counterclockwise about screw hinge 240. The top edge of the upper portion of trigger 222 bears against grip 228 and urges it forward. As grip 228 is biased forward from the top it becomes more angled. Eventually grip 228 attains a critical angle where it engages plunger shaft 14, and further retraction of trigger 222 is converted into lateral movement of plunger drive shaft 14. Constricted spring 600 maintains a limited degree of frictional pressure on plunger shaft 14. Spring 600 rides forward on the plunger shaft 14 as trigger 22 is retracted until it becomes lodged against the angle-bracket 476, and plunger shaft 14 continues to slide through the angle-bracket 476 and constricted spring 600.

Upon release, trigger 222 is return-biased by compression springs 30 and 250 and pivots clockwise about pivot 240 toward its home position. The forward bias is removed from grip 228, and grip 228 moves backward allowing compression springs 30 and 250 to recoil. The constricted spring 600 grips plunger shaft 14 and rides backward thereon until it becomes compressed against the rear wall of housing 220. This freedom provides limited initial release of the plunger shaft 14, and momentarily relieves pressure on the caulk cartridge. When the constricted spring 600 is sufficiently compressed against the rear wall of housing 220, its frictional grip maintains engagement with the plunger shaft 14 to prevent further retraction. Consequently, the same dripless feature is provided by momentarily removing pressure from the caulk cartridge, and the plunger shaft 14 is safely held against loose sliding within the housing.

Again, the angle bracket 476 and constricted spring 600 may alternatively be mounted externally (protruding behind the housing 220).

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

In the claims:

1. A drip-stop resistance assembly for a caulking gun of the type having a frame with a downwardly extending handle, a plunger shaft slidably supported in said frame for dispensing caulking composition, a trigger pivoted to said frame and retractable against said handle, and a plunger drive mechanism for engagement with said trigger and advancement of said plunger shaft when said trigger is retracted, the resistance assembly comprising:

a removable resistance clip inserted on said plunger shaft and adapted for frictionally gripping said shaft, said resistance clip having a limited degree of freedom to ride said plunger shaft within said frame; and constraint means for limiting the degree of freedom of said resistance lip within said frame, said constraint means including a forward and rearward constraint;

whereby said resistance clip frictionally grips and rides said plunger shaft forward as said trigger is retracted until said resistance clip encounters said forward constraint, thereby causing said plunger shaft to slide through the resistance clip, and upon initial release of said trigger said resistance clip frictionally grips and rides said plunger shaft backward until said resistance clip encounters said rearward constraint and prevents further retraction of said plunger shaft, said resistance assembly thereby providing limited initial release of the plunger shaft to momentarily relieve pressure within the caulk cartridge.

2. The drip-stop resistance assembly for a caulking gun according to claim 1, wherein said rearward constraint comprises a back-plate washer mounted on said plunger shaft behind said resistance clip, and a compression spring mounted on said plunger shaft behind said back-plate washer for providing bias.

3. The drip-stop resistance assembly for a caulking gun according to claim 1, wherein said plunger drive mechanism includes a grip, and said resistance clip is inserted onto said plunger shaft forwardly of said grip.

4. The drip-stop resistance assembly for a caulking gun according to claim 1, wherein said forward constraint comprises a bracket attached to a rear wall of said frame and protruding forwardly therefrom to a vertical section having a through-bore through which said plunger shaft passes, said resistance clip being inserted behind said vertical section whereby said vertical section provides said forward constraint.

5. The drip-stop resistance assembly for a caulking gun according to claim 4, wherein said resistance clip further comprises a resistance clip formed in an annular yoke for encircling said plunger shaft rearwardly of the vertical section of the bracket.

6. The drip-stop resistance assembly for a caulking gun according to claim 5, whereby said rearward constraint is provided by said frame.

7. The drip-stop resistance assembly for a caulking gun according to claim 1, wherein said resistance clip is formed in an annular yoke for encircling said plunger shaft.

8. The drip-stop resistance assembly for a caulking gun according to claim 7, wherein said resistance clip imparts a frictional resistance against sliding of said plunger shaft.

9. The drip-stop resistance assembly for a caulking gun according to claim 7, wherein the free ends of said resistance clip are flared outwardly to facilitate insertion onto said plunger shaft.

10. The drip-stop resistance assembly for a caulking gun according to claim 9, wherein said resistance clip can be easily inserted and removed on/from said plunger shaft from above said housing when blow-back occurs for cleaning or replacement to avoid fouling of said plunger drive mechanism.

11. The drip-stop resistance assembly for a caulking gun according to claim 9, wherein said resistance clip, can be easily inserted and removed on/from said plunger shaft from beneath said housing when blow-back occurs for cleaning or replacement to avoid fouling of said plunger drive mechanism.

12. The drip-stop resistance assembly for a caulking gun according to claim 7, wherein said resistance clip can be easily inserted and removed on/from said plunger shaft when blow-back occurs for cleaning or replacement to avoid fouling of said plunger drive mechanism.

13. The drip-stop resistance assembly for a caulking gun according to claim 12, wherein said resistance clip is formed from a length of resilient spring steel.

14. The drip-stop resistance assembly for a caulking gun according to claim 13, wherein said resilient spring steel is surface treated for smoother friction.

15. The drip-stop resistance assembly for a caulking gun according to claim 13, wherein said resilient spring steel is plastic coated for smoother friction.

16. The drip-stop resistance assembly for a caulking gun according to claim 13, wherein said resistance clip is partially ensheathed in plastic sleeves for smoother friction.

17. A resistance clip formed in an annular yoke for encircling a plunger shaft of a caulk gun, said resistance clip being insertable onto said plunger shaft and adapted for frictionally gripping said shaft, and having a limited degree of freedom to ride said plunger shaft between a forward and rearward constraint, whereby said resistance clip frictionally grips and rides said plunger shaft forward until said clip encounters said forward constraint, thereby causing said plunger shaft to slide through the resistance clip, and said resistance clip frictionally grips and rides said plunger shaft backward until said clip encounters said rearward constraint and prevents further retraction of said plunger shaft, said resistance clip thereby providing limited initial release of the plunger shaft to momentarily relieve pressure within a caulk cartridge.

* * * * *